US007918676B2

(12) United States Patent
Tonosaki

(10) Patent No.: US 7,918,676 B2
(45) Date of Patent: Apr. 5, 2011

(54) CONNECTOR WITH A CONNECTION DETECTING FUNCTION AND WITH A FORCE MULTIPLYING MEMBER

(75) Inventor: Takashi Tonosaki, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/784,578

(22) Filed: May 21, 2010

(65) Prior Publication Data

US 2010/0304604 A1 Dec. 2, 2010

(30) Foreign Application Priority Data

May 27, 2009 (JP) ..... 2009-127856

(51) Int. Cl.
*H01R 13/62* (2006.01)

(52) U.S. Cl. ..... 439/157

(58) Field of Classification Search ..... 439/157, 439/357, 924.1, 372, 489
See application file for complete search history.

(56) References Cited

U.S. PATENT DOCUMENTS

| | | | | |
|---|---|---|---|---|
| 6,358,101 | B1 * | 3/2002 | Noro et al. | 439/752 |
| 6,705,881 | B2 * | 3/2004 | Tsuchiya | 439/157 |
| 6,755,673 | B2 * | 6/2004 | Fukushima et al. | 439/157 |
| 6,986,686 | B2 * | 1/2006 | Shibata et al. | 439/650 |
| 7,458,835 | B2 * | 12/2008 | Kobayashi et al. | 439/188 |
| 7,488,197 | B2 | 2/2009 | Shinozaki | |

* cited by examiner

*Primary Examiner* — T C Patel
*Assistant Examiner* — Phuongchi T Nguyen
(74) *Attorney, Agent, or Firm* — Gerald E. Hespos; Michael J. Porco

(57) ABSTRACT

First and second connector housings (10, 40) are connected by displacing a force multiplying member (24). The first housing (10) includes a pair of detection terminals (13) and a shorting member (19). The shorting member (19) is displaced between a shorting position where the detection terminals (13) are shorted and a releasing position where the detection terminals (13) are released from a shorted state. The force multiplying member (24) includes a pressing surface (29) that is parallel to a displacing direction of the force multiplying member (24). The pressing surface (29) displaces the shorting member (19) to the shorting position in a partly connected state where the two housings (10, 40) have not reached a completely connected state while displacing the shorting member (19) to the releasing position when the two housings (10, 40) reach the completely connected state.

7 Claims, 9 Drawing Sheets

CONNECTOR WITH A CONNECTION DETECTING FUNCTION AND WITH A FORCE MULTIPLYING MEMBER

BACKGROUND OF THE INVENTION

1. Field of the Invention

The invention relates to a connector with a connection detecting function.

2. Description of the Related Art

U.S. Pat. No. 7,488,197 discloses a connector that can detect whether connector housings are connected completely. This connector has a lock arm that resiliently deforms and pushes a first detection terminal away from a second detection terminal while the housings are being connected (partly connected state). The lock arm resiliently returns when the two housings reach a completely connected state. As a result, the first detection terminal also resiliently returns into contact with the second detection terminal. Thus, the connector detects whether the two housings are connected completely or partly based on whether the first and second detection terminals are in contact.

Foreign matter can intrude between the two detection terminals of the above-described connector and can short the two detection terminals in a state where the detection terminals should not be in contact (i.e. in the partly connected state of the housings). Thus, the foreign matter can cause an erroneous detection that the two housings have reached the completely connected state even though the housings are in the partly connected state. An operation of connecting the two housings may be stopped prematurely in an incomplete partly connected state.

The invention was developed in view of the above situation and an object thereof is to enable connection of two housings to be completed in a correct form.

SUMMARY OF THE INVENTION

The invention relates to a connector with first and second housings that are connectable with one another. The connector also has at least one displaceable force multiplying member on the first housing. The first and second housings are connected by displacing the force multiplying member engaged with the second housing. The connector further has at least two detection terminals in the first housing and at least one shorting member in the first housing. The shorting member is displaceable in a direction intersecting a displacing direction of the force multiplying member between a releasing position where the detection terminals are released from a shorted state and a shorting position where the detection terminals are shorted. A biasing means is provided for biasing the shorting member toward the releasing position. A pressing surface is formed on the force multiplying member and is substantially parallel to the displacing direction of the force multiplying member. The pressing surface can displace the shorting member toward or to the shorting position in a partly connected state where the first and second housings have not reached a completely connected state, while permitting a return of the shorting member towards or to the releasing position when the first and second housings reach the completely connected state. The shorted state of the detection terminals during the connection process confirms that the first and second housings are connected only partly and the release of the detection terminals from the shorted state confirms that the first and second housings are connected completely.

Foreign matter could intrude between the two detection terminals and could short the two detection terminals, thereby erroneously detecting the partly connected state even when the housings already have reached the completely connected state. Accordingly, a corresponding measure, such as a reattempt to operate the force multiplying member invariably is taken in an effort to connect the housings completely. In other words, the connecting operation of the two housings will not be finished in an incomplete state and the connecting operation will be completed in a correct form. The force multiplying member is utilized to displace the shorting member from the releasing position to the shorting position. Thus, the number of parts is smaller as compared with the case where a member for displacing the shorting member from the releasing position to the shorting position is provided in addition to the force multiplying member.

The first housing and the force multiplying member preferably are made of synthetic resin.

The first housing preferably has an arm that is displaceable in a direction intersecting the displacing direction of the force multiplying member. The arm is adapted to transmit a pressing force from the pressing surface to the shorting member by being at least partly interposed between the pressing surface and the shorting member.

The displacing directions of the force multiplying member and the shorting member intersect each other. Thus, the synthetic resin force multiplying member may be damaged by the metallic shorting member if the pressing surface directly contacts the shorting member. However, the pressing surface presses the shorting member via the synthetic resin arm. Accordingly, the shorting member will not damage the synthetic resin pressing surface.

The force multiplying member preferably has a lock that engages the arm separated from the pressing surface when the first and second housings are connected completely. The engagement of the arm and the lock prevents displacement of the force multiplying member.

The arm engages the lock when the first and second housings reach the completely connected state. As a result, the force multiplying member is locked and cannot displace. The arm portion doubles as a locking means for preventing displacement of the force multiplying member. Thus, a simpler construction is realized as compared with the case where a special locking means is provided in addition to the arm.

The arm preferably is deformed resiliently upon displacing the shorting member to the shorting position. A resilient restoring force accumulated in the arm then resiliently returns the arm to a locking position where the arm engages the lock. Thus, the arm and the lock can be engaged reliably.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
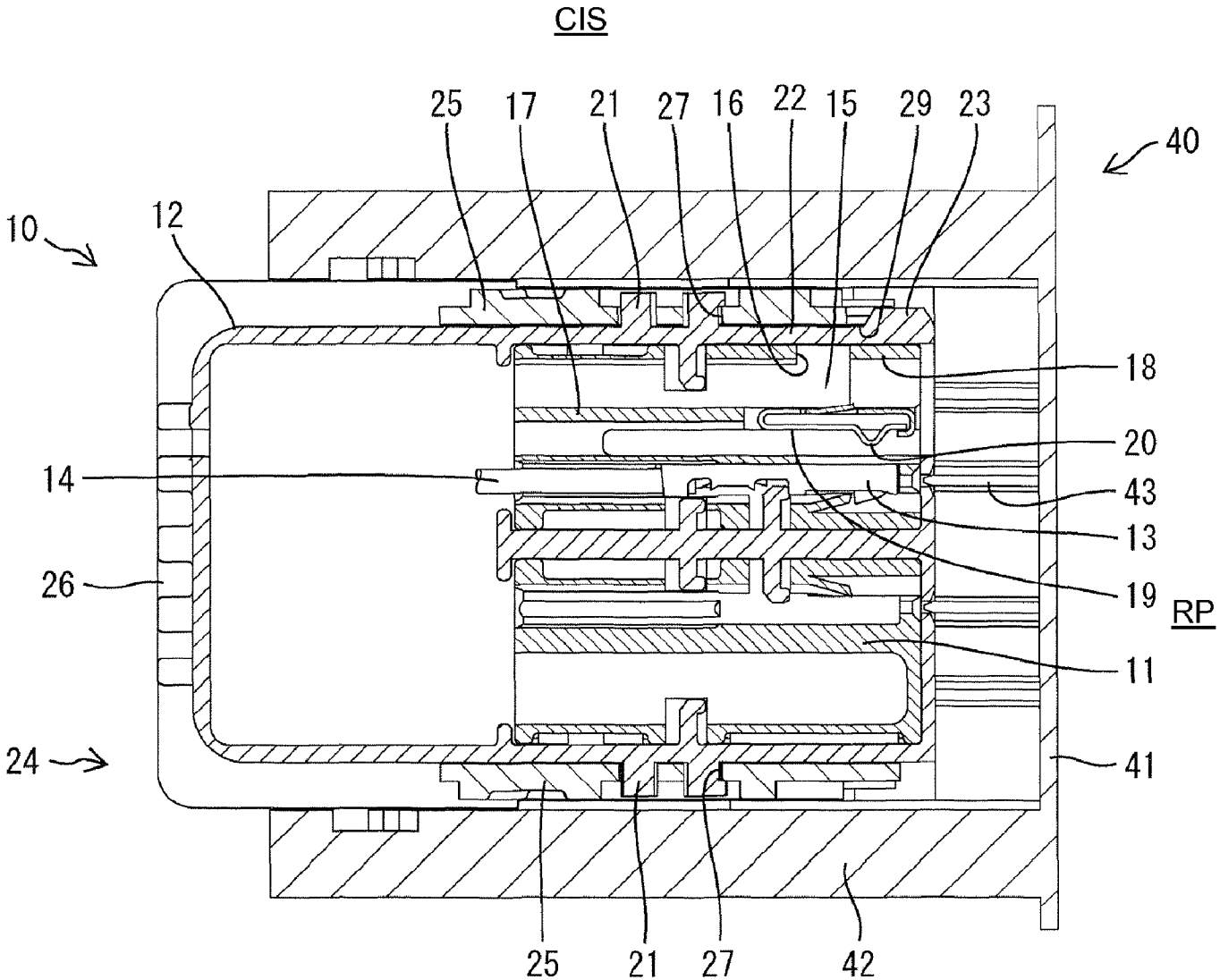
FIG. 1 is a section showing a connection initial state where two connector housings are lightly connected in one embodiment.

A connector in accordance with the invention is provided with first and second housings identified respectively by the numerals 10 and 40 in FIGS. 1 to 9. The first and second housing 10 and 40 are connectable with each other and the connector has a function of detecting a connected state of the two housings 10, 40.

The first housing 10 is formed by assembling two housing main bodies 11 made e.g. of synthetic resin and a wire cover 12 made e.g. of synthetic resin. The housing main bodies 11 are substantially block shaped and are arranged substantially adjacent and one above the other in the wire cover 12. Two female detection terminals 13 and a plurality of female terminal fittings (not shown) are accommodated in the housing main bodies 11. Wires 14 are connected with the respective detection terminals 13 and the female terminal fittings, and parts of these wires 14 exposed from the rear wire drawing surfaces of the housing main bodies 11 are bent laterally at an angle of substantially 90° or 180° in the wire cover 12. The wires 14 then are bundled and pulled out of the wire cover 12.

The left and right detection terminals 13 are arranged at substantially the height in the upper housing main body 11. These detection terminals 13 form a short-circuit detecting circuit (not shown) that detects whether or not the two detection terminals 13 are shorted and this detection result is output. An operation space 15 is formed substantially adjacent to or above the two detection terminals 13 in the housing main body 11, and the outer surfaces of front end portions of the detection terminals 13 are exposed in the operation space 15. The upper wall of the operation space 15 has a front end edge partly cut out to form an escaping recess 16.

A resilient support 17 is unitary to the housing main body 11 and is accommodated in the operation space 15. The resilient support 17 is cantilevered forward, and an outwardly pressable portion is formed near the front end of the resilient support 17. The resilient support 17 normally extends substantially horizontally at a releasing position (see FIGS. 1 and 3). However, the resilient support 17 can be inclined down or in toward the front from the releasing position to a shorting position (see FIG. 2). The shorting position SP is closer to the detection terminals 13 than the releasing position RP. A displacing direction of this resilient support 17 intersects a displacing direction DD of a force multiplier 24 to be described later. Further, the resilient support 17 functions as a biasing means for biasing a shorting member 19 toward a releasing position RP.

A conductive metallic shorting member 19 is attached to the resilient support 17. Left and right contacts 20 project from the inner or lower surface of the front end of the shorting member 19. An area of the shorting member 19 behind the contacts 20 is fixed to the resilient support 17, for example, by press-fitting, so that the shorting member 19 is displaceable with the resilient support 17 between the releasing position RP (see FIGS. 1 and 3) and a shorting position SP (see FIG. 2). The shorting member 19 normally is held at the releasing position RP, similar to the resilient support 17, but is displaceable toward the detection terminals 13 and to the shorting position SP below the releasing position RP while resiliently deforming the resilient support 17. The left and right contacts 20 are held in contact with the upper surfaces of the left and right detection terminals 13 when the shorting member 19 is displaced to the shorting position SP to establish electrical connections and to short the two detection terminals 13.

The wire cover 12 has a substantially box shape with an open front end to permit the housing main bodies 11 to be mounted and withdrawn. A side surface of the wire cover 12 at its rear end is formed with window holes for permitting the wires 14 to be drawn out. Supporting shafts 21 project up and down from the outer surfaces of the upper and lower walls of the wire cover 12. The force multiplying member 24, to be described later, is supported on the supporting shafts 21. Left and right slits extend back from the front edge of the upper wall of the wire cover 12 and a part of the upper wall adjacent between the two slits defines an arm 22 that is cantilevered forward. A projection 23 projects up and out from the front extending end of the arm 22.

The arm 22 normally is held at a standby position (see FIGS. 1 and 3), but is resiliently displaceable to an operating position (see FIG. 2) below the standby position. A displacing direction of arm 22 intersects a displacing direction DD of the force multiplying member 24 to be described later. The arm 22 that has been displaced from the standby position to the operating position moves through the escaping recess 16 of the housing main body 11 and enters the operation space 15. The lower surface of the arm 22 contacts the upper surface of the pressable portion 18 when the arm 22 is at the standby position and the resilient support 17 and the shorting member 19 are at the releasing positions RP. Accordingly, the arm 22 presses the pressable portion 18 down and in as the arm 22 is displaced from the standby position to the operating position. As a result, the resilient support 17 and the shorting member 19 are displaced together with the arm 22 from the releasing positions RP to the shorting positions SP. At this time, the resiliently deformed arm 22 and resilient support 17 have accumulated resilient restoring forces that become driving forces for the return to the standby position and the releasing position RP.

The force multiplying member 24 is made e.g. of synthetic resin and has upper and lower plate-like main portions 25 connected by an operable portion 26. A bearing hole vertically penetrates each main portion 25 and the bearing holes 27 engage the supporting shafts 21 to mount the force multiplying member 24 on the wire cover 12 so that the main portions 25 face the outer surfaces of the wire cover 12. The mounted force multiplying member 24 is supported rotatably substantially along a displacing direction DD between an initial position IP (see FIG. 4) and a connection position CP (see FIG. 6). Cam functioning portions are arranged substantially on an arc formed on the outer surface of each of the upper and lower main portions 25 and cooperate with driving-side projections.

A pressing surface 29 is defined on a part of the lower surface of the upper main portion 25. The pressing surface 29 faces the arm 22 from the outside in the process of displacing the force multiplying member 24 between the initial position IP and the connection position CP. The height of the pressing surface 29 does not change in a vertical direction that intersects the displacing direction DD of the force multiplying member 24 and is substantially parallel with the displacing directions of the arm 22 and the shorting member 19 even if the force multiplying member 24 is rotated. This height is lower than the height of the upper end of the projection 23 when the arm 22 is at the standby position.

The upper main portion 25 is formed with an initial position lock 30 and a connection position lock 31 by partly cutting out its outer peripheral edge. The initial position lock 30 substantially faces the projection 23 of the arm 22 when the force multiplying member 24 is at the initial position IP, whereas the connection position lock 31 substantially faces the projection 23 when the force multiplying member 24 is at the connection position CP. In other words, the pressing surface 29 is between the initial position lock 30 and the connection position lock 31 in a rotating direction DD of the force multiplying member 24 (circumferential direction).

The second housing 40 is made e.g. of synthetic resin and has a terminal holding portion 41 and a receptacle 42 that projects forward from the outer peripheral edge of the terminal holding portion 41. Male terminal fittings 43 are accommodated in the receptacle 42 and are connectable with the detection terminals 13 and/or the female terminal fittings. A cam follower (not shown) is formed on the inner surface of each of the upper and lower walls of the receptacle 42, in which driven-side projections (not shown) are arranged in a connecting direction of the two housings 10, 40.

Figure 4:
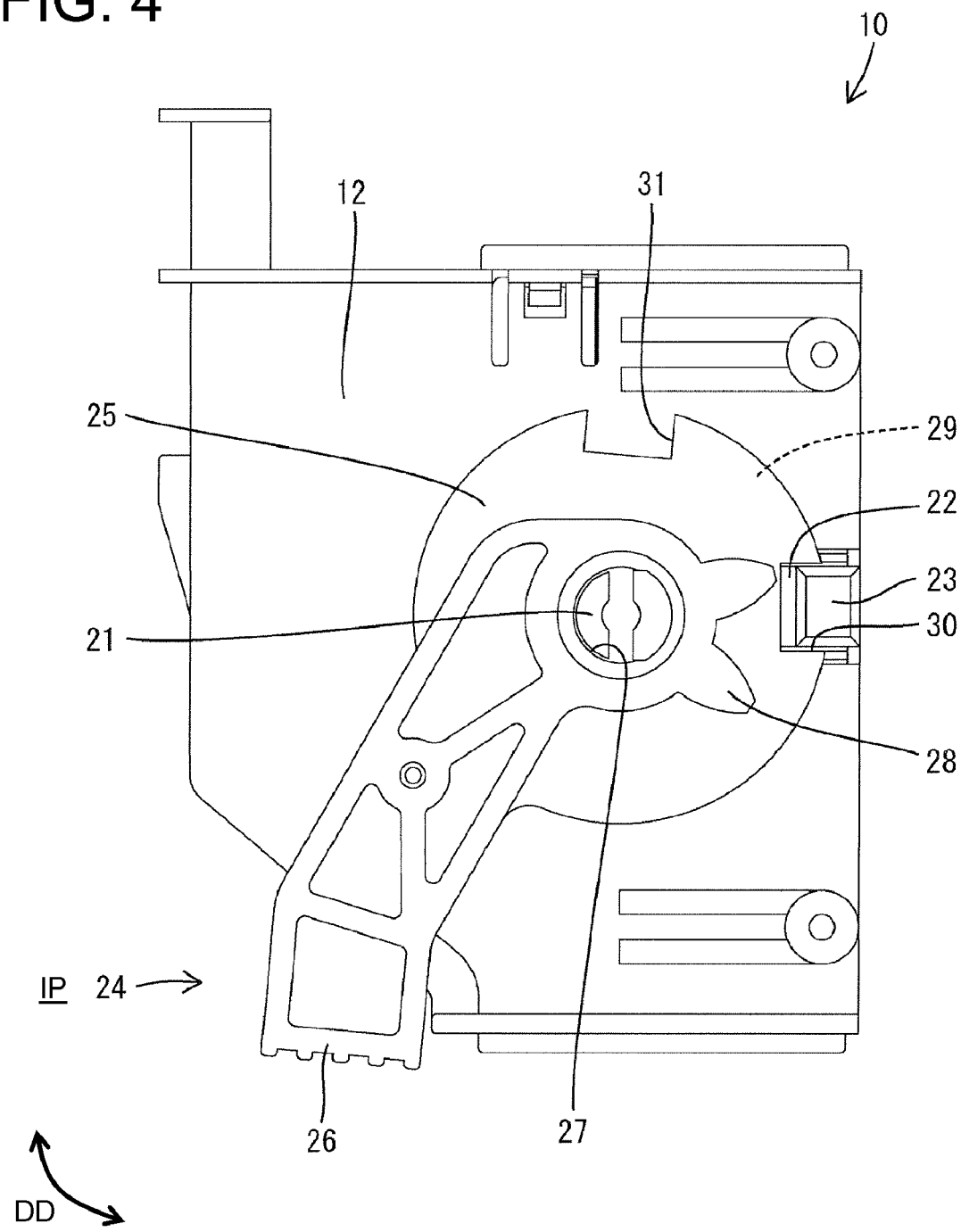
FIG. 4 is a plan view of a first housing showing a state where a force multiplying member is at an initial position.

The force multiplying member 24 is at the initial position IP on the first housing 10, as shown in FIG. 4, prior to connecting the two housings 10, 40. At this time, the projection 23 of the arm 22 engages the initial position lock 30 to prevent rotation of the force multiplying member 24 and to hold the force multiplying member 24 at the initial position IP. The side surfaces of the projection 23 are slanted so that the force multiplying member 24 is held in a semi-locking manner. FIG. 1 shows a connection initial state CIS where the two housings are connected lightly and where the projection 23 engages the initial position lock 30 so that the arm 22 resiliently returns to the standby position. Thus, the arm 22 exerts no inward or downward pressing force on the pressable portion 18 of the shorting member 19. Therefore, the shorting member 19 is held at the releasing position RP and the detection terminals 13 are held so as not to short with each other.

The first housing 10 is fit lightly into the receptacle 42 of the second housing 40, as shown in FIG. 1, so that the cam followers and the cam functioning portions 28 engage. A rotational force exceeding an engaging force of the projection 23 and the initial position lock 30 then is exerted on the operable portion 26 so that the arm 22 is displaced resiliently down and in from the standby position toward the operating position. Thus, the projection 23 disengages from the initial position lock 30 and the force multiplying member 24 starts rotating from the initial position IP toward the connection position CP.

Figure 2:
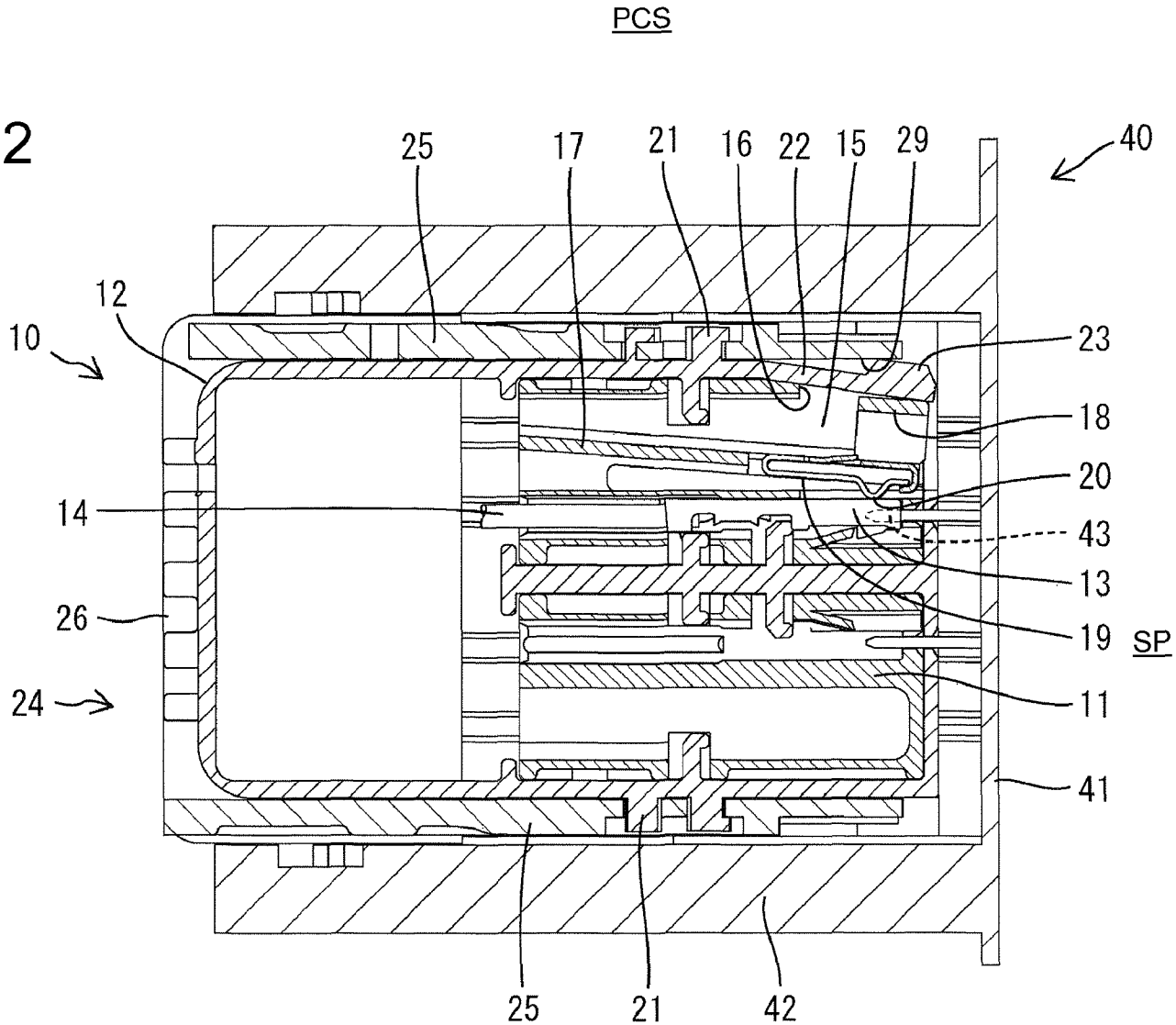
FIG. 2 is a section showing a partly connected state of the two housings.
Figure 5:
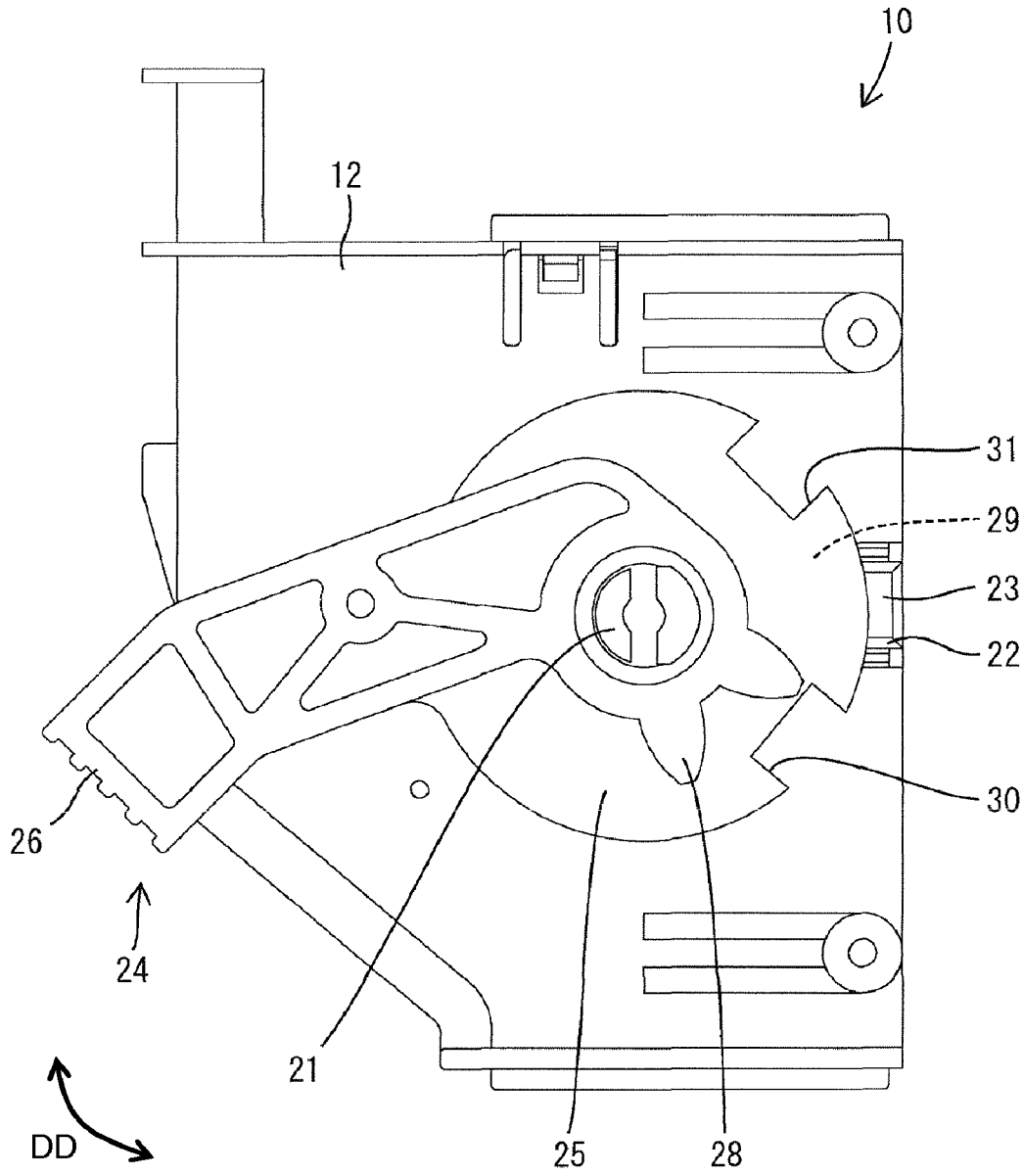
FIG. 5 is a plan view of the first housing showing a state where the force multiplying member is between the initial position and a connection position.

Rotation of the force multiplying member 24 causes the cam functioning portions 28 and the cam followers to engage and cooperate for pulling the two housings 10, 40 toward each other so that a connecting operation of the two housings 10, 40 proceeds or is assisted. The arm 22 slips under the upper main portion 25 displaces to the operating position as the force multiplying member 24 starts rotating and the projection 23 slides on the pressing surface 29 of the force multiplying member 24, as shown in FIGS. 2 and 5. In other words, the pressing surface 29 presses the arm 22 down and in. The lower surface of the arm 22 presses the pressable portion 18 when the arm 22 is displaced to the operating position. As a result, the shorting member 19 is displaced from the releasing position RP to the shorting position SP while resiliently deforming the resilient support 17. The shorting member 19 shorts the detection terminals 13 when the shorting member 19 is displaced to the shorting position SP. The shorted state is detected by the short-circuit detecting circuit (not shown) and a detection signal from the short-circuit detecting circuit judges that the two housings 10, 40 are in a partly connected state PCS.

Figure 3:
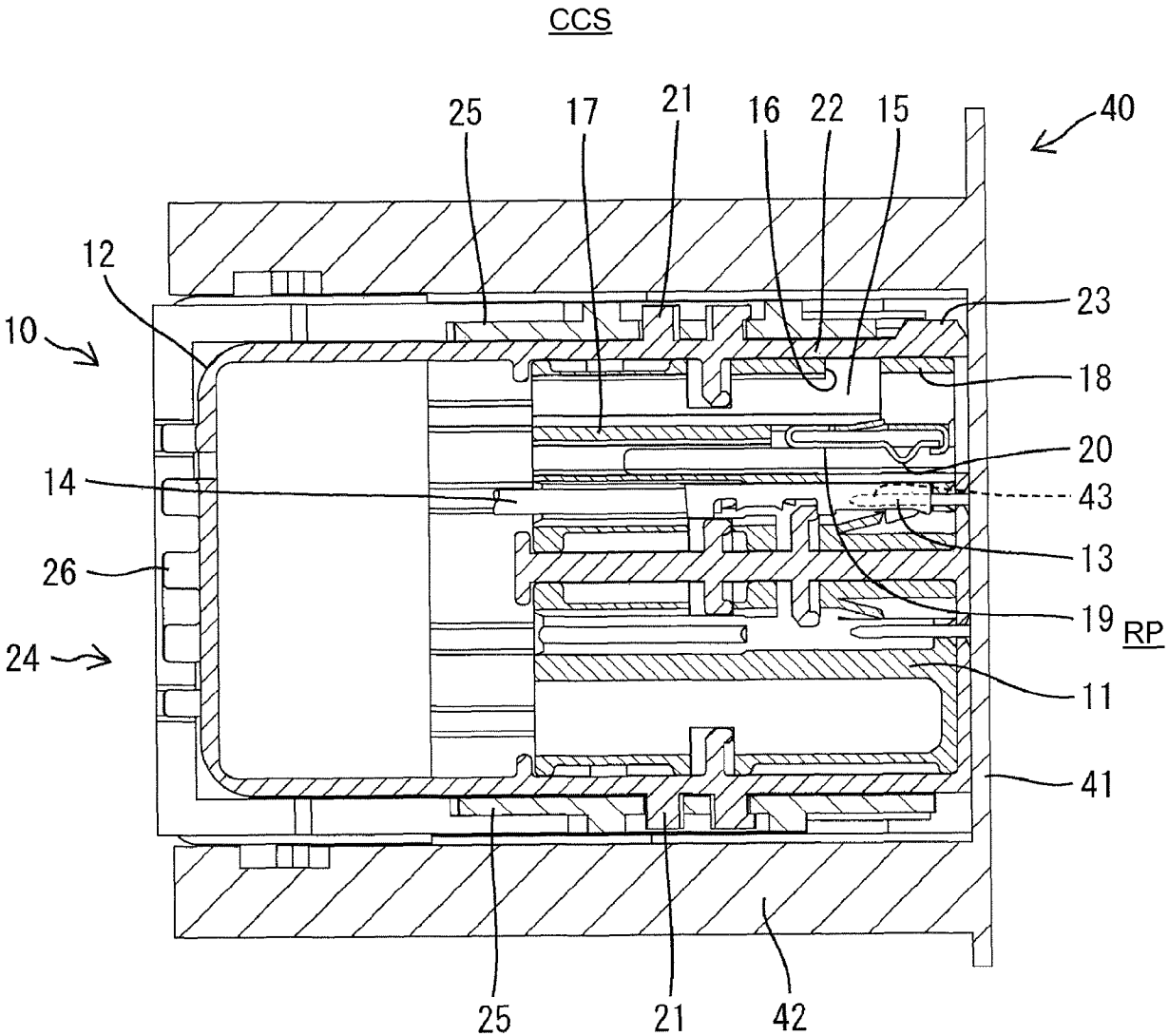
FIG. 3 is a section showing a completely connected state of the two housings.
Figure 6:
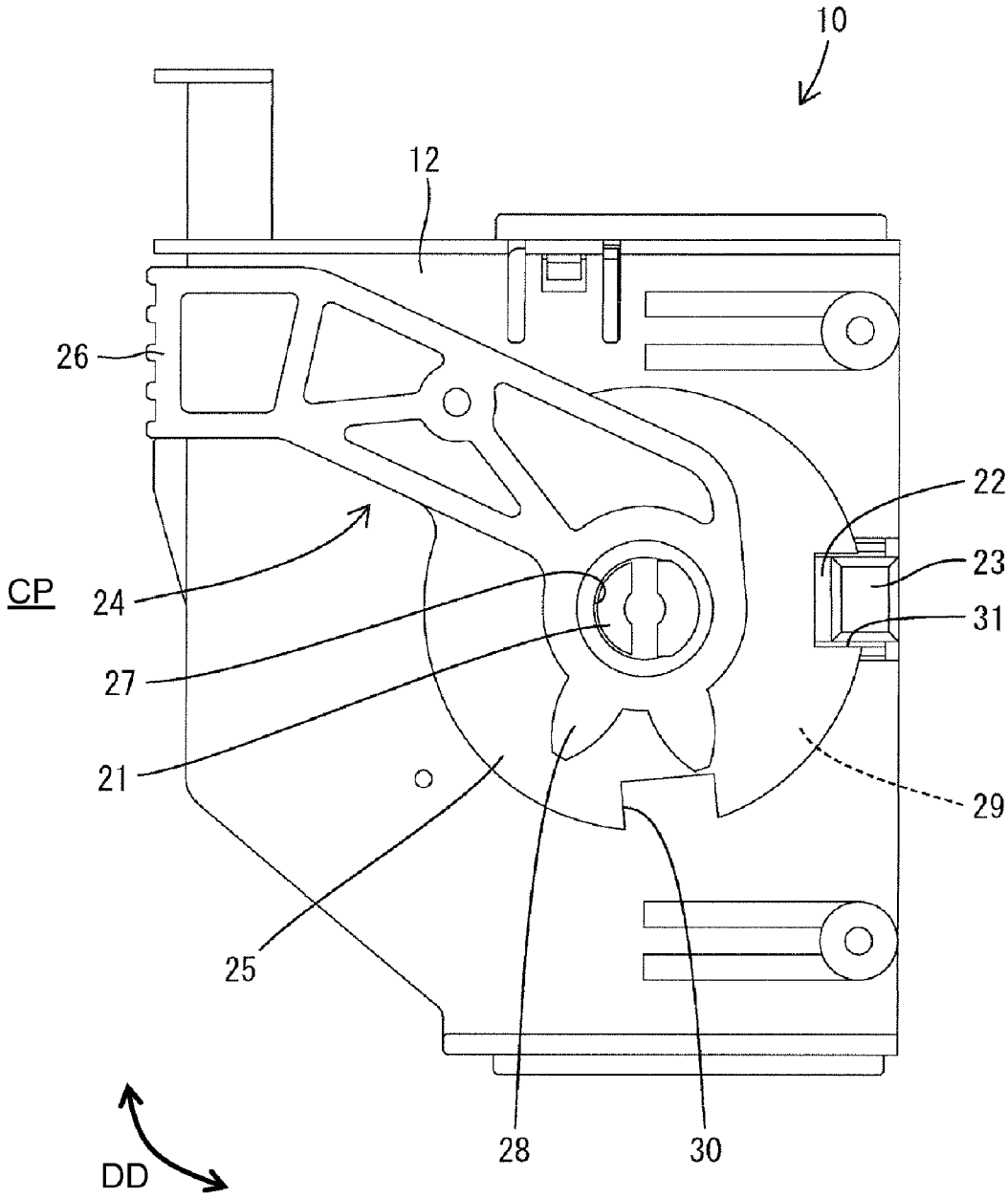
FIG. 6 is a plan view of the first housing showing a state where the force multiplying member is rotated to the connection position.
Figure 7:
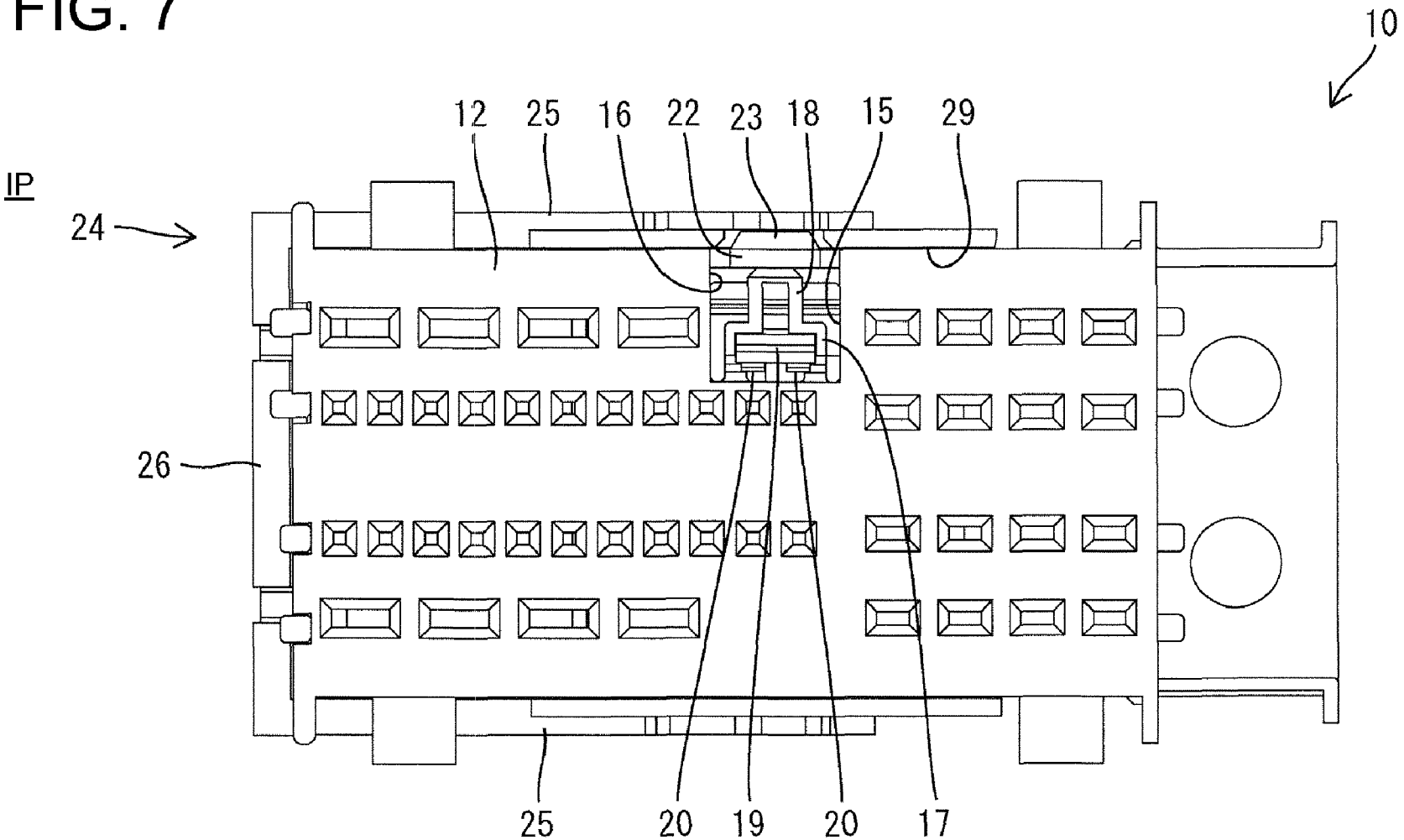
FIG. 7 is a front view of the first housing showing the state where the force multiplying member is at the initial position.
Figure 8:
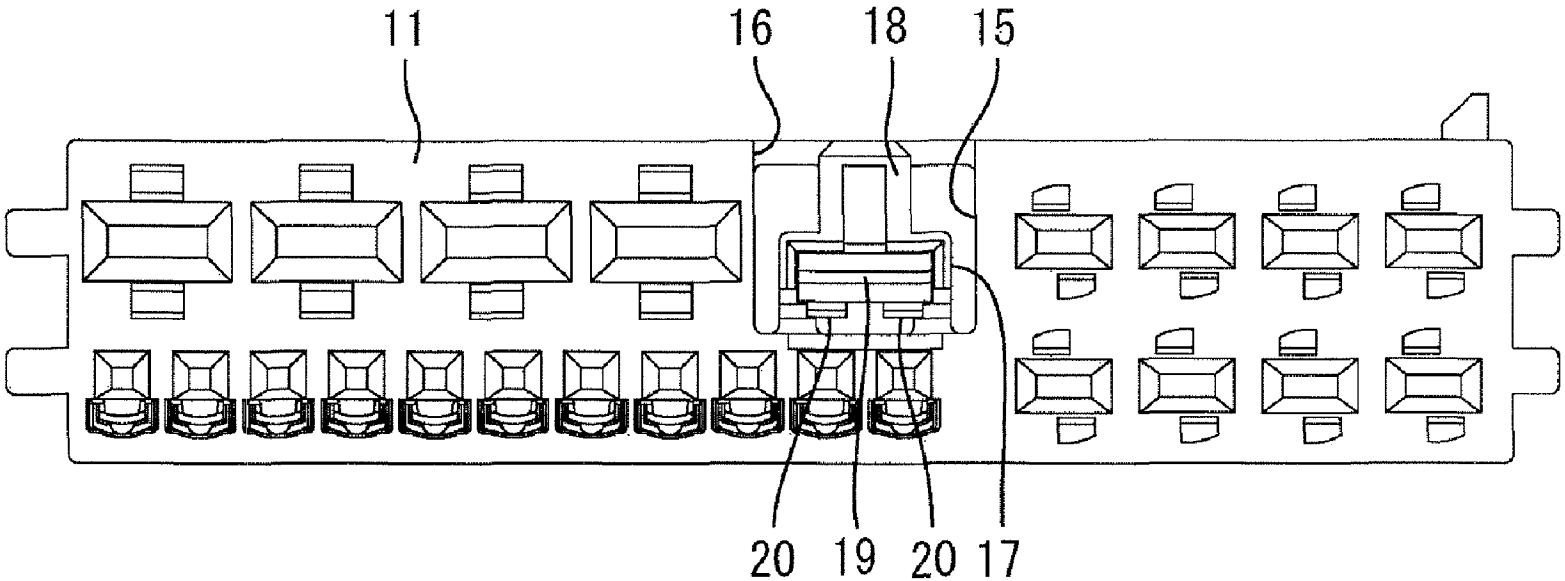
FIG. 8 is a front view of a housing main body.
Figure 9:
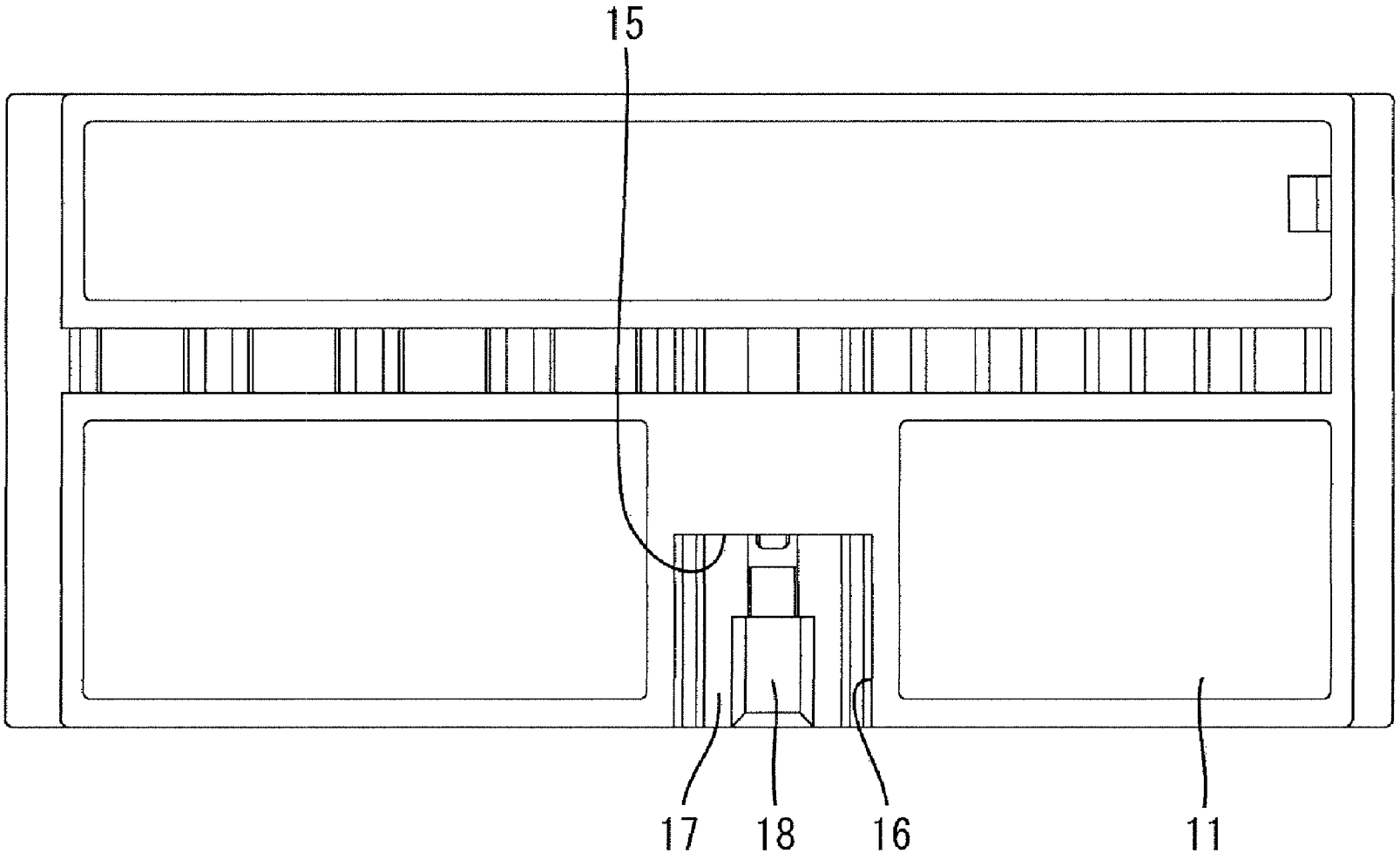
FIG. 9 is a plan view of the housing main body.

The two housings 10, 40 reach the completely connected state CCS when the force multiplying member 24 reaches the connection position CP. As a result, the female terminal fittings and the male terminal fittings 43 are connected and the respective detection terminals 13 are connected with the corresponding male terminal fittings 43, as shown in FIG. 3. Further, the projection 23 disengages from the pressing surface 29 and faces the connection position lock 31 when the force multiplying member 24 reaches the connection position CP. Thus, the resilient restoring force accumulated in the arm 22 resiliently returns the arm 22 to the standby position. The projection 23 engages the connection position lock 31, as shown in FIG. 6, as the arm 22 resiliently returns to the standby position. Therefore the force multiplying member 24 is held in a semi-locking manner with the rotational movement prevented.

The resilient restoring force accumulated in the resilient support 17 resiliently returns the shorting members 19 from the shorting positions SP to the releasing positions RP when the arm 22 resiliently returns to the standby position. The detection terminals 13 are released from the shorted state when the shorting member 19 resiliently returns to the releasing position RP and the short-circuit detecting circuit detects this short-circuit released state. A detection signal from the short-circuit detecting circuit indicates that the two housings have reached the completely connected state CCS (FIG. 3). In other words, the connected state of the two housings 10, 40 is detected based on whether the detection terminals 13 are shorted with each other.

An operational force exceeding the engaging force of the projection 23 and the connection position lock 31 is exerted to the operable portion 26 of the force multiplying member 24 to separate the two housings 10, 40 from the connected state. The arm 22 then resiliently displaces from the standby position to the operating position and the projection 23 disengages from the connection position lock 31. The force multiplying member 24 starts rotating toward the initial position IP. The cam functioning portions 28 engage the cam followers and separate the two housings 10, 40 as the force multiplying member 24 is rotated. During this time, the arm 22 slips under the upper main portion 25 and the pressing surface 29 presses the arm 22 down from the standby position to the operating position. Therefore the shorting member 19 also is displaced from the releasing position RP to the shorting position SP and the detection terminals 13 are shorted.

The cam functioning portions 28 and the cam followers disengage when the force multiplying member 24 reaches the initial position so that the two housings 10, 40 may be pulled apart. The projection 23 faces the initial position lock 30 when the force multiplying member 24 reaches the initial position. Thus, the resilient restoring force of the arm 22 resiliently returns the arm 22 to the standby position, and the projection 23 and the initial position lock 30 engage in a semi-locking manner to hold the force multiplying member 24 at the initial position IP. The resilient restoring force of the resilient support 17 resiliently returns the shorting member 19 from the shorting positions SP to the releasing positions RP when the arm 22 resiliently returns to the standby position. Therefore, the detection terminals 13 are released from the shorted state.

The shorting member 19 resiliently returns to the releasing position RP and the two detection terminals 13 are separated when the two housings 10, 40 reach the completely connected state CCS (FIG. 3) at the end of a connecting operation. Therefore the detection terminals 13 should be released from the shorted state. However, conductive foreign matter can intrude between the shorting member 19 and the detection terminals 13 and can short the detection terminals 13. In this case, a detection signal indicating the shorted state of the detection terminals 13 is output from the short-circuit detecting circuit, and the short-circuit detecting circuit erroneously judges that the two housings 10, 40 are still partly connected despite the fact that the two housings are connected completely.

An indication of a partly connected state PCS cannot be left. Thus, regardless of whether this judged partly connected state PCS is correct, a corresponding measure invariably is taken, such as the confirmation of the connected state of the two housings 10, 40 or redoing the connecting operation. As a result, the two housings 10, 40 finally are connected completely. Thus, the connecting operation of the two housings 10, 40 will not be finished in an incomplete state and the connecting operation of the two housings 10, 40 can be completed in a correct form.

The force multiplying member 24 for connecting the housings 10, 40 with a small operational force is used to move the shorting member 19 from the releasing position RP to the shorting position SP. Thus, the number of parts is smaller than a case where a member for displacing the shorting member 19 from the releasing position RP to the shorting position SP is provided in addition to the force multiplying member 24.

The first housing 10 and the force multiplying member 24 are made of synthetic resin and the displacing direction DD of the force multiplying member 24 and the displacing direction of the shorting member 19 intersect. Thus, the metallic shorting member 19 may damage the synthetic resin force multiplying member 24 if the pressing surface 29 directly contacts the shorting member 19. Accordingly, the arm 22 and the pressable portion 18 of the first housing 10 are interposed between the pressing surface 29 and the shorting member 19, so that the pressing surface 29 indirectly presses the shorting member 19 via the arm 22 and the synthetic resin pressable portion 18. Accordingly, the synthetic resin pressing surface 29 and the metallic shorting member 19 do not rub or exhibit friction against each other by direct contact, and there is no likelihood that the shorting member 19 will damage the pressing surface 29 (force multiplying member 24).

The force multiplying member 24 can be held at the initial position IP or connection position CP by engaging the projection 23 of the arm 22 with the initial position lock 30 and/or the connection position lock 31 formed on the force multiplying member 24. The arm 22 that transmits a pressing force from the pressing surface 29 to the shorting member 19 doubles as a locking means for preventing the movement of the force multiplying member 24. Thus, a simpler construction is realized as compared with the case where a special locking means is provided in addition to the arm 22.

The arm 22 deforms resiliently when the shorting member 19 is displaced to the shorting position and resiliently returns to the engaged positions with the locks 30, 31 (i.e. standby position) due to resilient restoring force accumulated therein. Thus, the arm 22 reliably returns to the standby position and reliably engages the locks 30, 31.

The invention is not limited to the above described and illustrated embodiment, and the following embodiments also are included in the scope of the invention.

The pressing surface indirectly displaces the shorting member to the shorting position via the arm of the first housing in the above embodiment. However, the pressing surface may directly press the shorting member to the shorting position.

The first housing has housing main bodies and the wire cover in the above embodiment, but the first housing may be a single part.

The force multiplying member is displaced rotationally about the supporting shafts in the above embodiment, but it may make a substantially linear movement.

The shorting member is attached to the resilient support of the first housing and a resilient restoring force of the resilient support returns the shorting member from the shorting position to the releasing position in the above embodiment. However, the resilient restoring force of the shorting member itself may be a biasing means.

The arm functions as the lock for preventing displacement of the force multiplying member in the above embodiment. However, a special lock for preventing displacement of the force multiplying member may be provided in addition to the arm.

The arm returns to a position for engaging the lock by its own resilient restoring force in the above embodiment. However, a biasing force given to the shorting member may be used to displace the arm to the position where the arm engages the lock without using the resilient restoring force of the arm itself.

In the above embodiment, the detection terminals are connected with the terminal fittings of the second housing and form current paths between circuits of the first and second housings. However, the detection terminals may not be connected with the terminal fittings of the second housings in the completely connected state of the housings and function as special terminals for detecting the connected state of the housings.

What is claimed is:

1. A lever-type connector, comprising:

a first housing;

a second housing connectable with the first housing;

at least one force multiplying member provided displaceably on the first housing, the first and second housings being connected by displacing the force multiplying member engaged with the second housing;

at least two detection terminals provided in the first housing;

at least one shorting member in the first housing and displaceable in a direction intersecting a displacing direction of the force multiplying member between a releasing position where the detection terminals are released from a shorted state and a shorting position where the detection terminals are shorted;

a biasing means for biasing the shorting member toward the releasing position; and a pressing surface formed on the force multiplying member and being substantially parallel with a displacing direction of the force multiplying member and adapted to displace the shorting member to the shorting position in a partly connected state where the first and second housings are partly connected while permitting a return of the shorting member (19) to the releasing position when the first and second housings reach a completely connected state.

2. The lever-type connector of claim 1, wherein, in the process of connecting the first and second housings, it is detected based on the shorted state of the detection terminals that the first and second housings are partly connected and it is detected based on the release of the detection terminals from the shorted state that the first and second housings are completely connected.

3. The lever-type connector of claim 1, wherein the first housing and the force multiplying member are made of synthetic resin.

4. The lever-type connector of claim 1, wherein the first housing is formed with an arm displaceable in a direction intersecting with the displacing direction of the force multiplying member and configured to transmit a pressing force from the pressing surface to the shorting member by being interposed between the pressing surface and the shorting member.

5. The lever-type connector of claim 4, wherein the force multiplying member is formed with at least one lock to be engaged with the arm separated from the pressing surface when the first and second housings are completely connected.

6. The lever-type connector of claim 5, wherein a displacement of the force multiplying member is prevented by engagement of the arm and the lock.

7. The lever-type connector of claim 6, wherein the arm is resiliently deformed upon displacing the shorting member to the shorting position and resiliently returns to a locking position, where the arm is engaged with the lock, by a resilient restoring force accumulated therein.

* * * * *